United States Patent [19]

Lischka, geb. Woitzik

[11] Patent Number: 4,572,360

[45] Date of Patent: Feb. 25, 1986

[54] HERB PACKAGE

[76] Inventor: Helga Lischka, geb. Woitzik, Post Ponholz, 8414 Brücklhof, Fed. Rep. of Germany

[21] Appl. No.: 758,813

[22] Filed: Jul. 25, 1985

[30] Foreign Application Priority Data

Aug. 10, 1984 [DE] Fed. Rep. of Germany ... 8423841[U]

[51] Int. Cl.[4] ..... B65D 33/01

[52] U.S. Cl. ..... 206/0.5; 383/100

[58] Field of Search ..... 206/0.5; 383/100, 101, 383/102, 103

[56] References Cited

U.S. PATENT DOCUMENTS 2,826,484 3/1958 Buehler ..... 206/0.5
3,792,979 2/1974 Clinton ..... 206/0.5
3,833,740 9/1974 Schmidt ..... 206/0.5
4,345,512 8/1982 Moore ..... 206/0.5

*Primary Examiner*—Joseph Man-Fu Moy
*Attorney, Agent, or Firm*—Charles W. Fallow; Martin P. Hoffman

[57] ABSTRACT

The herb package described is made of a synthetic foil having therein plural perforations for allowing fluids, but not solids, to exit and/or enter the package. The perforations are formed by needling, created inward or outward deformation of the foil at each puncture point, whereby each perforation tends to act as a one-way valve in a direction corresponding to the direction of needle penetration. Some of the perforations are formed by inward needling, some by outward needling, so that pressure cycling pumps water through the package contents.

3 Claims, 2 Drawing Figures

HERB PACKAGE

This invention relates to an infusion package for bathing herbs, comprising a pouch made of synthetic foil defining a space for the reception of herbs, which foil has a multiplicity of perforations to allow water to enter and exit the pouch.

BACKGROUND OF THE INVENTION

Medicinal or health baths often contain extracts from herbs as medicinally effective additives which are added to the water in a bathtub or in a basin, for example in the form of liquid herb extracts. A precise dosing is often difficult. Moreover, the liquid herb extracts offered on the market at the present contain additional substances, such as emulsifiers, additional binders or preservatives. Such additives are not desirable in many instances.

For this reason, herb packages have previously been proposed which contain herbs in dry form in a water-permeable pouch. Additives, especially preservatives, are basically unnecessary with these herb packages. To prepare a medicinal or health bath with this type of package, one or more pouches—depending upon the desired concentration of herb extracts in this bath—are placed into the water. The herbs impart their active substances into the water through the water-permeable surface of the package, whereby the herbs remain within the pouch, which can later be removed from the bath without difficulty. This also avoids the danger of loose softened herbs plugging up the drain pipe from the bath or basin.

In order to facilitate locating a herb package in the bath, it would be advantageous to produce a herb package which floats on the surface of the water. A floating package would further ensure that upon draining the bath, the package itself would not block the drain. However, known floating herb packages are relatively expensive, particularly so whenever additional floating or buoyancy bodies or elements are used.

It is therefore an object of the present invention to develop a herb package of the type described above that it is capable of floating even without having additional floating or buoyancy bodies or elements. A further object is to provide a floating herb package which when in use ensures as thorough mixing as possible of the water with the herbs present in the herb package or with the medicinally effective substances imparted by the herbs.

To attain these and other objects, a perforated herb package according to the invention is designed so that the synthetic foil around each perforation forms a projection extending beyond one said surface of the synthetic foil. Furthermore, the projections defining a portion of the perforations protrude from the outside surface of the pouch, and the projections defining the remainder of perforations protrude inwardly from the inside surface of the pouch.

The perforations in the synthetic foil constituting the pouch, in the case of the herb package according to the invention, have such a small diameter that the herbs contained in the package are not capable of passing through the perforations to the outside.

In order to form the perforations and the surrounding projections, the synthetic foil is pierced with fine perforating needles from both sides either before the production of the pouch or after its production so as to form not only perforations, but also the projections because of lasting deformation of the surrounding material, into truncated, coneshaped sections. Because of their surrounding projections, the perforations, owing to the inherent elasticity of the synthetic material used, have the tendency to open or close somewhat when differential pressures exist on opposite sides of the foil. Thus, the perforations in the outwardly extending protrusions widen when the package sides are pressed together, that is to say in the case of an excess pressure, while the perforations in the inwardly extending projections close up. On the contrary, in the case of an enlargement of the inside space of the herb package, for example, by extending this package, the perforations defined by the inwardly protruding projections are somewhat enlarged while the other perforations close up. As a result of this valve-action, there results a very homogenous water flow through the inside space of the herb package. Moreover, as a result of the design of the herb package, a certain residual quantity of air always remains in the inside space of the herb package, so that said package is capable of floating even without the use of additional floating or buoyancy bodies.

For the production of the herb package, polypropylene foil is particularly suitable.

BRIEF DESCRIPTION OF THE DRAWING

The invention will be explained in greater detail in the following paragraphs describing a preferred embodiment of the invention with reference to the accompanying drawing, wherein.

DESCRIPTION OF A PREFERRED EMBODIMENT

Figure 1:
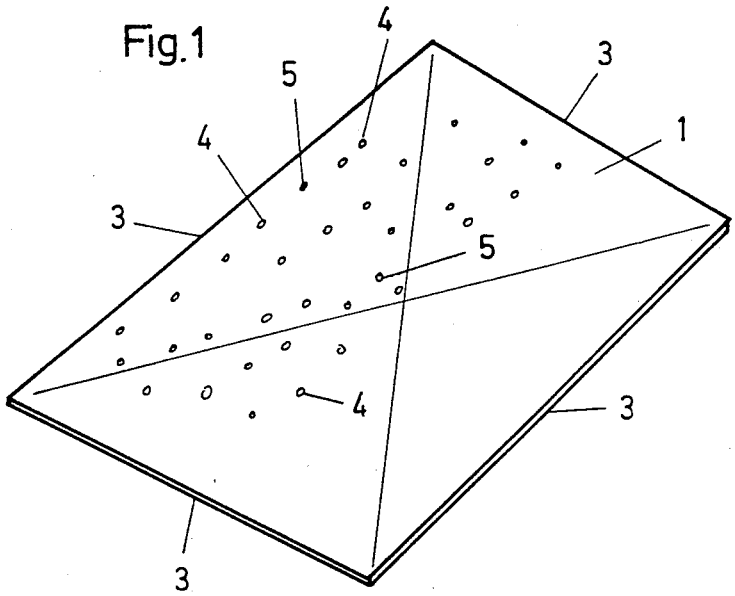
FIG. 1 is a perspective view of one embodiment of the herb package according to the invention.
Figure 2:
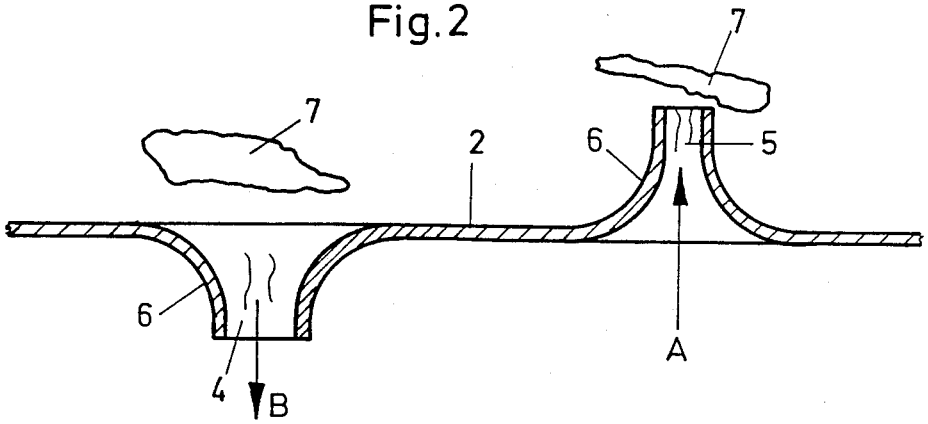
FIG. 2 is an enlarged cross-sectional view of a perforated synthetic foil used for the production of the herb package.

The herb package 1 shown in the figures consists of two blanks 2 made of synthetic foil which in the case of the embodiment shown have a rectangularly shaped periphery 3 and are connected by welding with one another along this peripheral line to form a closed pouch. Alternatively, the herb package 1 may also be produced from a single blank bent over or folded in half so that said blank forms two layers lying on top of one another whereby to close the pouch, connection along only three sides of the peripheral line 3 is required. Or, a tubular blank of synthetic foil may also be used from which a pouch is formed by closing the two ends of this blank.

In any case, the synthetic material forming the blank or the blanks 2 is provided with a multiplicity of perforations 4 and 5 which are formed by the pressing or piercing action of preferably pointed, small diameter needles so that in the material of the blank 2 in the area of each perforation 4 or 5, a section 6 is formed shaped approximately like a truncated cone and lying with its axis perpendicular to the surface sides of the blank 2, the inside diameter of the cone narrowing down toward the pertinent perforation 4 or 5 starting our from either side of the blank 2. The perforations 4 and their protruding sections 6 are produced simultaneously by piercing the material of the blank 2, or the assembled synthetic foil package from one side thereof. The perforations 5 and their pertinent sections 6 are pierced from the opposite side of the foil. The sections 6, with the respective perforations 4 thus form protrusions which project beyond one surface of the blank 2 (for example, toward the outside of the pouch of the herb package 1) while the sections 6 with their perforations 5 project beyond the other surface side of the blank (the inside surface of the pouch of the herb package) toward the inside space.

For the formation of the openings 4 and 5 or of the sections 6, sufficiently fine perforation needles are used that the openings 4 and 5 produced have a very small cross section whereby herbs 7 contained in the herb package cannot pass to the outside through the openings 4 and 5 no matter whether they are dry, in the moist state or wet. On the other hand, passage of water and also of air corresponding to the arrows A and B through the openings 5 and 4 into the inside space of the pouch of the herb package 1 or through the openings 4 from this inside space to the outside freely occurs.

Through the piercing of the opening 4 and 5 with perforation needles or as a result of the perforated, coneshaped sections 6, the openings 4 and 5, on the basis of the inherent elasticity of the synthetic material, have a tendency to close up substantially which contributes to the fact that herbs 7 are unable to pass from the herb package. In case a vacuum is created in the inside of the herb package, which vacuum is produced, for example, by the two layers of the pouch of the herb package 1 being extended by hand, the openings 5 or the respective sections 6 will widen, while the openings 4 and their respective sections 6 will close even further so that through the openings 5 (according to the arrow A) water and possibly also small quantities of air may reach the inside of the herb package 1. Whenever the herb package 1 is compressed so that in the inside space of this package an excess pressure develops, the openings 5 and their respective sections 6 close, while the openings 4 and the pertinent sections 6 widen so that water is exhausted through the openings 4 (according to the arrow B) again in such a way that herbs 7 cannot reach the outside from the inside space of the herb package 1. As a result of this valve effect, there is an advantageous through-flow of the inside space of the herb package 1 (according to the arrows A and B) of water. The agitation of the effective substances of the herbs 7 within the herb package is accomplished as a result of the development described.

Also, a certain residual air quantity always remains in the inside space of the herb package 1, especially when the diminution or enlargement of the inside space of the herb package 1 is made by hand on the surface of the water of a health bath so that the herb package will float even without additional floating bodies or buoyancy elements. The escape of the residual air quantity from the inside space of the herb package 1 through the openings 4 and 5 is prevented in the case of the lack of an outside pressure on the herb package 1 by the fact that either herbs 7 place themselves in front of the openings 4 and 5, or else these openings are closed by drops of water or residual water located at the openings which on the basis of their surface tension retain the residual air quantity within the herb package 1.

Especially as a result of the sections 6 projecting beyond the outside surface of the herb package 1 or of the pouch of said herb package, the herb package 1 has as a result a rough outside surface, so that when the moist herb package 1 is rubbed on the skin of the user, an advantageous massaging effect is achieved. Also, as a result of the multiplicity of the perforations 4 and 5, the herb package 1 may easily be molded or bent in every desired direction. As a result of the use of a synthetic foil, the pouch of the herb package 1 cannot dissolve in water even in the case of an extended use, so that the herbs 7 are kept securely and reliably within the package 1.

It should be understood that the invention is subject to changes and variations. For example, the pouch shape need not be rectangular, and could take other forms. Therefore, the above description should be taken as only illustrative of the invention, whose scope is to be measured by the following claims.

I claim:

1. A herb package comprising a pouch defining an inside space for the reception of the herbs, said pouch being made of synthetic foil, said foil having a multiplicity of openings, the synthetic foil forming around each opening a protrusion defining said opening and projecting beyond one surface of the synthetic foil, a portion of said protrusions projecting outward beyond the outside surface of the pouch the remainder of said protrusions projecting into the inside space of the pouch.

2. A herb package as in claim 1, wherein the projections are formed by truncated conical sections.

3. A herb package as in claim 1, wherein the synthetic foil is a polypropylene material.

* * * * *